US005248174A

United States Patent [19]

Matz et al.

[11] Patent Number: 5,248,174

[45] Date of Patent: Sep. 28, 1993

[54] SECURITY LOCK FOR SASH WINDOW

[75] Inventors: Dennis A. Matz, Mokena; Steven E. Schultz, Orland Park, both of Ill.

[73] Assignee: Ashland Products, Inc., Chicago, Ill.

[21] Appl. No.: 975,071

[22] Filed: Nov. 20, 1992

[51] Int. Cl.[5] ..... E05C 17/44

[52] U.S. Cl. ..... 292/338; 292/DIG. 47

[58] Field of Search ..... 292/338, 339, DIG. 47, 292/DIG. 15, 63, 67

[56] References Cited

U.S. PATENT DOCUMENTS

| | | | |
|---|---|---|---|
| 1,698,944 | 1/1929 | De Foe | 292/338 |
| 4,824,154 | 4/1989 | Simpson | 292/338 |
| 4,923,230 | 5/1990 | Simpson | 292/338 X |

*Primary Examiner*—Richard E. Moore

*Attorney, Agent, or Firm*—Wallenstein, Wagner & Hattis, Ltd.

[57] ABSTRACT

A security lock for a double-hung sash window assembly which is to be mounted in a stile of a sash frame to limit movement of a lower sash frame relative to an upper sash frame. The lock includes a casing adapted to be mounted within a recess formed in the upper sash frames, and a faceplate on the casing having an opening therein communicating with an interior casing cavity. A tumbler pivots in the cavity and is spring biased by a leaf spring to normally project through the opening to engage the lower sash in a locking position. The leaf spring is mounted completely within the casing cavity normally to bias the tumbler into its extended, locking position, but permitting the tumbler to be completely retracted within the casing cavity so that the lower sash frame can be raised and moved past the tumbler. The tumbler and casing wall include interlocking protrusions to prevent over-rotation of the tumbler during engagement with the lower sash frame. The lock can be supplied as an assembled unit for installation.

7 Claims, 2 Drawing Sheets

SECURITY LOCK FOR SASH WINDOW

BACKGROUND OF THE INVENTION

A double-hung sash window assembly typically includes a window frame and a pair of window sashes mounted for vertical reciprocal sliding movement, one relative to the other, on guide rails in the master frame jamb of the window assembly. Although window sashes traditionally have been made exclusively of wood, window sashes are often formed of extruded plastic or metal frame members which are joined at mitered corners, for instance, to form a generally rectangular frame in which glazing is mounted. An example of this type of window sash is described in U.S. Pat. No. 4,578,903, having the same assignee as the present invention.

Window sashes also are known which include a sash lock or fastener which, when the sash is closed, automatically, locks and holds the sash in the closed position. The fastener includes a rectangular casing having an opening at its front end or face plate, in which opening a tumbler or dog is mounted. The casing is secured in the front surface of a window stile. The tumbler is mounted within the casing by a guiding device so that the tumbler may be pivotally projected forward or longitudinally to overlie the lower sash, and be moved laterally when projected forward to engage the casing and lock itself in position. The tumbler is biased into the projected position by a coiled, safety pin type spring mounted within the casing. This is more fully discussed in U.S. Pat. No. 4,923,230.

It has been found that in applications where large forces are applied to prior art tumblers, such as disclosed in the '230 patent, the backwall of the casing can deform under the increased horizontal force against the backwall imposed by the tumbler, and allow the tumbler protrusion to slide along the back wall and overrotate, permitting the windows to open.

The present invention is provided to solve this and other problems.

SUMMARY OF THE INVENTION

The security lock of the present invention, is for use in a double-hung sash window assembly having upper and lower sash window frames formed of assembled header and hollow stile members, and installed for vertical reciprocal sliding movement relative to one another. The outer face of the stile of the upper sash frame includes a recess opening into the interior thereof. The security lock includes a casing mounted in the recess and a faceplate on the casing and surrounding the perimetric edges of the recess. The faceplate includes an opening in communication with an internal cavity in the casing.

A pivot lug is secured to a wall of the casing, inside the casing cavity. An elongated tumbler having upper and lower ends is disposed in the casing cavity, and a leaf spring is mounted in the casing cavity between a wall of the casing and the tumbler. The upper end of the tumbler includes a member for pivotally mounting the tumbler on the pivot lug. The lower end of the tumbler is movable between a locking position and a retracted position in the opening of the faceplate relative to the header of the lower sash frame. One end of the leaf spring is restrained within the casing. The second end of the leaf spring is engaged with the tumbler to bias the lower end of the tumbler to protrude forwardly, beyond the opening in the faceplate, into a locking position. In a locking position, the tumbler engages the lower sash frame and prevents further sliding movement between the sash frames. The pivotally mounted tumbler is manually retractable into the cavity to disengage the lower end of the tumbler from the lower sash frame header. The faceplate and the pivot member are cooperatively engageable to releasably maintain the lower end of the tumbler in the retracted position. When the tumbler is retracted, relative sliding movement between the sash frames can occur.

In the improvement of the present invention, the tumbler includes an indentation forming an apex for engagement with a wedge-shaped protrusion extending from the back wall of the casing cavity. The apex and protrusion combine to produce a ratchet arrangement to limit movement of the tumbler in the extended position. The ratchet arrangement prevents over-rotation of the tumbler, if increasing force is applied to the lower extended portion of the tumbler during engagement with the lower sash frame.

Figure 3:
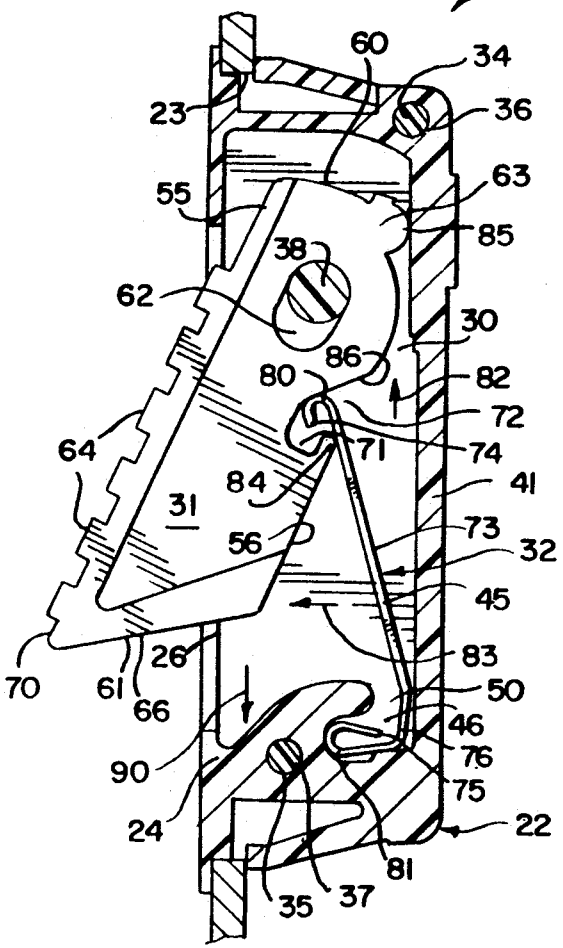
FIG. 3 PRIOR ART
FIG. 3 is a longitudinal sectional view taken along line 3—3 of FIG. 1 and in the direction indicated generally, depicting the prior art lock in its extended locked position.

Other features and advantages of the invention will be apparent from the following specification taken in conjunction with the following drawings.

DETAILED DESCRIPTION

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Figure 1:
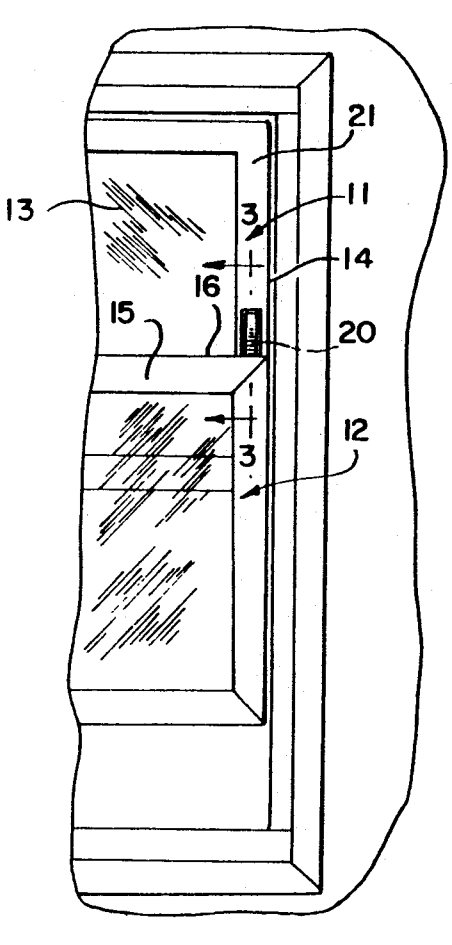
FIG. 1 PRIOR ART
FIG. 1 is a fragmentary illustration of a sash depicting a prior art self-contained security lock installed in an upper sash frame of a double-hung window assembly.

Referring to the drawings, FIG. 1 generally illustrates a representative double-hung sash window assembly 10 in a locked position, utilizing a prior art security lock. Such an assembly includes upper and lower sash window frames designated 11 and 12, respectively, and fitted with suitable glazing 13. The sashes 11 and 12 are conventionally mounted within a main jamb frame (not shown) for vertical reciprocal sliding movement therein. Both the jamb frame and the sashes 11 and 12 can be formed of different materials, such as metal or strong and rigid plastics well known in this field. The sashes 11 and 12 are preferably fabricated from elongate framinq members of hollow configuration and are generally rectangular in cross-section and rectilinear in configuration, but the shapes and configurations can vary. The upper sash 11 includes a stile 14, and the lower sash 12 includes a header 15 having an upper exterior surface 16. A prior art security lock is designated generally in FIG. 1 by reference numeral 20. This lock is depicted as installed in the exterior front surface 21 of the sash stile 14, and engaging the upper exterior surface 16 of the header 15 of the lower sash 21, in its locking position. The vertical location of the lock 20 in the stile 14 will depend upon the amount of vertical movement of the lower sash 12 that is desired before the upper header surface 16 engages the lock 20.

Figure 2:
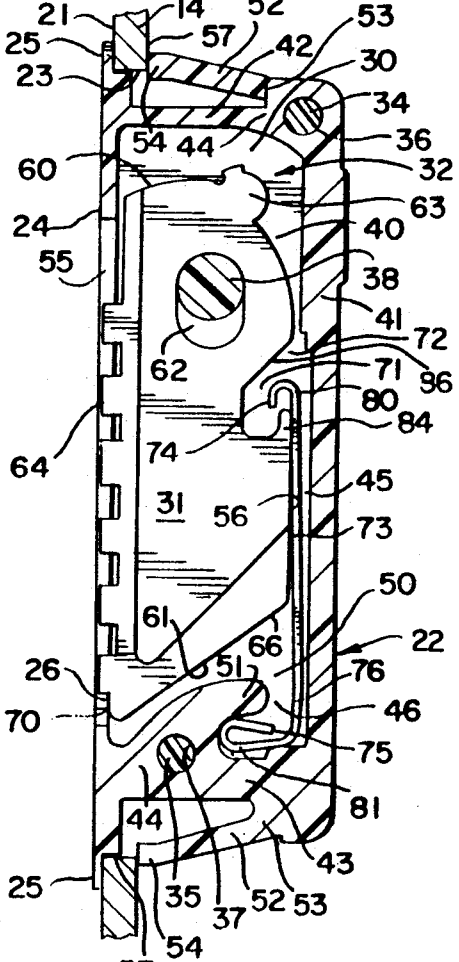
FIG. 2 PRIOR ART
FIG. 2 is a longitudinal sectional view taken through the installed prior art lock, but depicting the lock in its retracted unlocked position.

FIG. 2 illustrates the prior art lock 20 in a retracted, unlocked position. The lock 20 includes a casing 22 installed in an opening or recess 23 in the front surface 21 of the sash stile 14. The casing 22 has a front wall or faceplate 24 which overlaps the peripheral edge of the recess 23 to support the casing 22 therein and to furnish an attractive exterior appearance.

The faceplate 24 is formed as a solid one piece member and is configured to project only slightly forward of the front surface 21 of the stile 14 so as not to interfere with the relative sliding movement of the sashes 11 and 12. The faceplate 24 may be provided with a curved outer peripheral edge 25 to improve the outward aesthetic appearance of the lock.

The faceplate 24 includes a centrally located elongate vertical opening 26 which is in communication with an interior cavity 30 of the casing 22. An oblong tumbler 31 is mounted within the cavity 30 to pivot therein and to lockingly engage the upper exterior surface 16 of the lower sash header 15.

Figure 4:
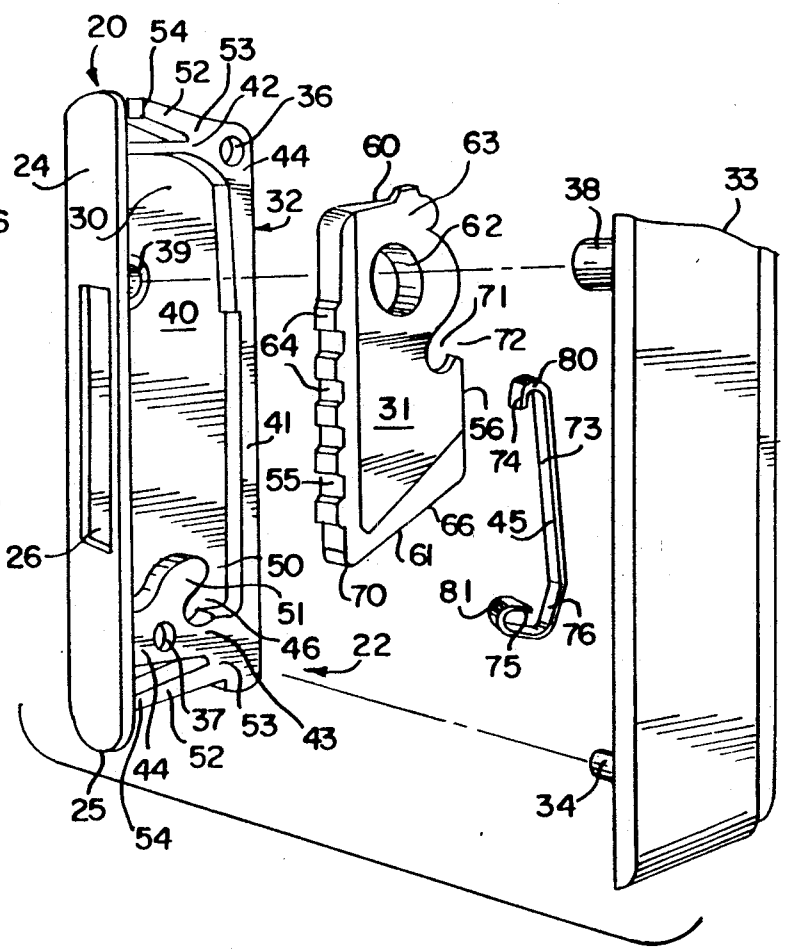
FIG. 4 PRIOR ART
FIG. 4 is an exploded perspective view of a prior art security lock.

Referring to FIG. 4, the prior art lock 20 is illustrated in greater detail. For ease of assembly, the casing 22 is formed by two mating portions, referred to respectively as a housing element 32 and a sidewall cover element 33. The housing element 32 is the larger of the two elements, and it is the housing 32 that defines the interior cavity 30 in which the tumbler 31 and a spring 45 are operatively located. The sidewall cover element 33 serves as a cover for the otherwise open side of the housing 32 and assists in retaining the tumbler 31 and spring 45 therein. The sidewall cover element 33 is attached to the housing 32 by means of a pair of lugs 34 and 35 which matingly engage bores 36 and 37 in the housing 32. FIG. 4 only illustrates the bottom lug 34 of the pair. The lugs 34 and 35 can be snap-fit within the bores 36 and 37, and secured with an adhesive or in any other desired way. Also forming part of the sidewall cover 33 is a pivot lug 38 which engages both the tumbler 31 and the housing 32 as will be described in detail later.

The housing 32 includes a back side 40 which opposes the sidewall cover 33, a back wall 41 which opposes the faceplate 24, a top wall 42 and a bottom wall 43. The faceplate 24, the back wall 41, the top wall 42 and the bottom wall 43 are all integral with the back side 40.

The top wall 42 and the bottom wall 43 are provided with enlarged portions 44 integral therewith, to provide support to the casing 22, and define the bores 36 and 37. In order to seat one end of the spring 45 within the casing 22, the back wall 41 is provided with an internal cavity 46 having a notch or passageway 50 between a wall portion 51 and the inside face of the back wall 41. The mounting of the spring 45 within the cavity 46 and the passageway 50 will be described in detail later. At both ends of the casing 22, the top and bottom walls 42 and 43 are provided with an elongate spring clip 52 positioned proximate thereto. Each clip 52 is integral at one end 53 with the back wall 41 and includes a free end 54. As shown in FIG. 2, the clips 52 are arranged so that they engage edges 57 of the stile surface 14, defining the opening 23, and exert a slight biasing force thereagainst to secure the casing 22 within the opening 23. In effect, the edges 57 are sandwiched between the clips 52 and the peripheral curved edge 25 of the faceplate 24.

The tumbler 31 includes a front edge 55, a rear edge 56, an upper end 60, and a lower end 61. To engage the pivot lug 38 and provide rotation to the tumbler 31, an ovate transverse aperture or pivot bore 62 is located near the upper end 60 of the tumbler 31, approximately equidistant from the front edge 55 and the rear edge 56. The upper end 60 of the tumbler 31 includes a cylindrical protrusion 63 which abuts a smooth portion 85 of the back wall 41 of the casing 22, when the tumbler 31 is in an extended or locked position as shown in FIG. 3. To assist in moving the tumbler 31, the front edge 55 includes a plurality of outstanding ribs 64. The ribs 64 assume a position transverse to the elongate vertical opening 26 in the faceplate 24.

The lower end 61 of the tumbler 31 includes a tapered lower edge 66 which assists the pivoting motion of the tumbler 31 within the opening 23. In addition, the lower edge 66 intercepts the front edge 55 to form an engagement portion 70 which is adapted to engage the faceplate 24 near the lower end of the opening 23 when the tumbler 31 is retracted into the casing 22. The interaction between the engagement portion 70 and the faceplate 24 locks the tumbler 31 into a retracted position as shown in FIG. 2.

The tumbler 31 includes a pocket 71 therein which extends from just below the pivot bore 62. An opening 72 in the rear edge 56 of the tumbler 31 communicates with the interior of the pocket 71.

The spring 45 preferably is a leaf spring formed of a flat elongate member which is substantially 'L'-shaped, having an elongate upper arm 73 integral at one end with a free end 74, and a lower arm 76 integral at the other end with a free end 75. Each of the free ends 74 and 75 are doubled over to form upper and lower hook formations 80 and 81 respectively. The upper hook formation 80 has a smaller radius than the lower hook formation 81, and the upper hook formation 80 is constructed to glide along the inside walls of the pocket 71 as the tumbler 31 moves between retracted and extended positions. The hook formation 80 is positioned within the internal cavity 46 to secure the spring 45 within the casing 22, and is integral with the lower arm 76, which is positioned within the passageway 50.

Referring to FIGS. 2, 3 and 4, to assemble the lock 20, the tumbler 31 is positioned in the cavity 30 of the housing 32 so that the pivot bore 62 is aligned with an aperture 39 in the back side 40 of the housing 32. Upon proper positioning of the spring 45, the sidewall cover 33 is snap-fit to the housing 32 by means of the mating lugs 34 and 35 and bores 36 and 37, and the pivot lug 38 is inserted through the pivot bore 62 in the tumbler 31 and snap fit into the aperture 39 in the back side 40 of the housing 32. The lock 20 can then be installed in the opening 23 of the stile 14 so that the spring clip members 52 snap into engagement with the edges 57 of the opening 23.

In the retracted position shown in FIG. 2, the tumbler 31 is positioned within the cavity 30 so that the ovate pivot bore 62 engages the pivot lug 38 at an upper end of the bore 62. In addition, the cylindrical protrusion 63 on the upper end 60 is not in contact with either the back wall 41 or the top wall 42 of the casing 22. The front edge 55 of the tumbler 31 is flush with the opening 23 in the faceplate 24 to facilitate the relative sliding action of the upper and lower sashes 11 and 12.

Referring to FIG. 3, when it is desired to place the lock 20 in an extended position, to prevent the upward sliding movement of the lower sash 12, the tumbler 31 is manually actuated with the assistance of ribs 64, and moved in an upward vertical direction indicated by the arrow 82. The upward movement of the tumbler 31 is terminated by the engagement of the pivot lug 38 with the lower end of the ovate pivot bore 62. The tumbler 31 need only be moved vertically upward a sufficient distance to permit the engagement portion 70 to clear the faceplate 24. As tumbler 31 moves in the direction of arrow 82, the edge 84 of the pocket opening 72 is enveloped in the hook formation 80. Once the engagement portion 70 is clear of the faceplate 24, the spring 45 propels the tumbler 31 forward through the opening 26, in the direction indicated by arrow 83. The tumbler 31 will move in the direction of arrow 83 until the cylindrical protrusion 63 on the tumbler upper end 60 contacts the smooth surface 85 of the back wall 41. The lower end 61 of the tumbler 31 normally extends outward from the casing 22 a distance approximately equal to three-fourths the length of the lower end 61, but this distance can vary. When the cylindrical protrusion 63 contacts the smooth portion 85 of the back wall 41, the force of the tumbler rotation is directed outwardly against the back wall 41 of the casing 22. The contact between the back wall 41 and the cylindrical protrusion 63 inhibits the rotation of the tumbler 31. However, if increased force is applied to the lower end 61 of the tumbler 31 while in the extended position, the increased outward force of the cylindrical protrusion 63 against the back wall 41 will cause the back wall 41 to rearwardly deform. Under great force, the back wall 41 may deform to such an extent that the cylindrical protrusion 63 can glide along the back wall 41, over-rotating the tumbler 31 and permitting the window to then fully open.

The tumbler 31 is easily retracted and locked within the opening 26, by first manually pushing the tumbler 31 inwardly with sufficient force to urge the cylindrical protrusion 63 away from the back wall 41. As the tumbler continues to be pushed inwardly, the free end 74 of the upper arm 73 slides along the roof 86 of the pocket 71 until the tumbler 31 is in a vertical position. The tumbler 31 can then be locked in the retracted position by moving the tumbler 31 downward as shown by arrow 90, with the assistance of the transverse ribs 64, until the engagement portion 70 of the tumbler 31 again makes contact with the faceplate 24.

Figure 5:
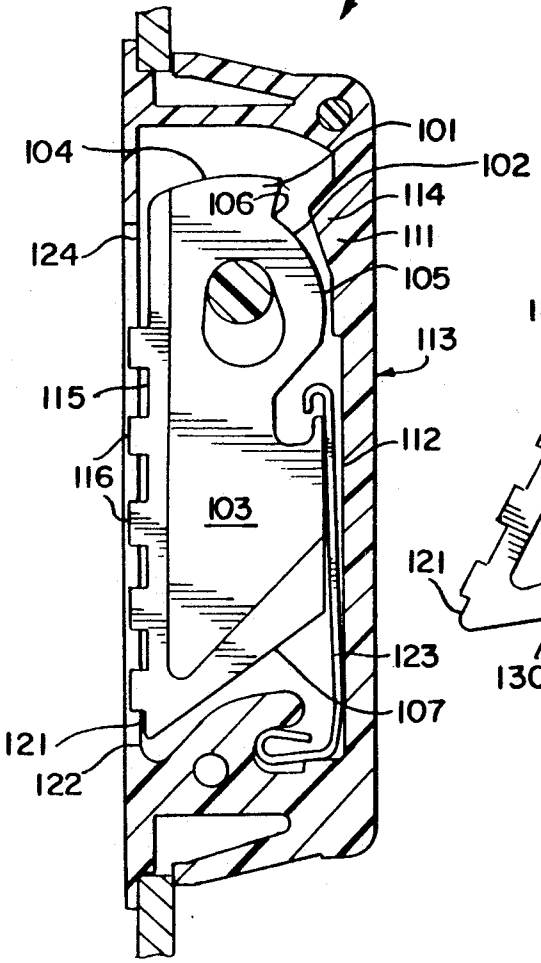
FIG. 5 is a longitudinal sectional view taken through a lock embodying the invention, depicting the lock in its retracted unlocked position.

FIG. 5 illustrates the security lock of the present invention, designated generally as 100, in a retracted unlocked position. In the lock 100, the cylindrical protrusion 63 of the prior art security lock has been replaced with an apex 101. The apex 101 is located in an upper arcuate portion 102 of tumbler 103 at a conflux of an upper end 104 and a rear edge 105.

Extending from an upper portion 111 of a back wall 112 of casing 113 is a wedge-shaped protrusion 114. This wedge-shaped protrusion 114 replaces the smooth portion 85 of the prior art back cavity wall 41. The protrusion 114 is constructed to engage the apex 101 of the tumbler 103, as the tumbler 103 is propelled into an extended position.

Figure 6:
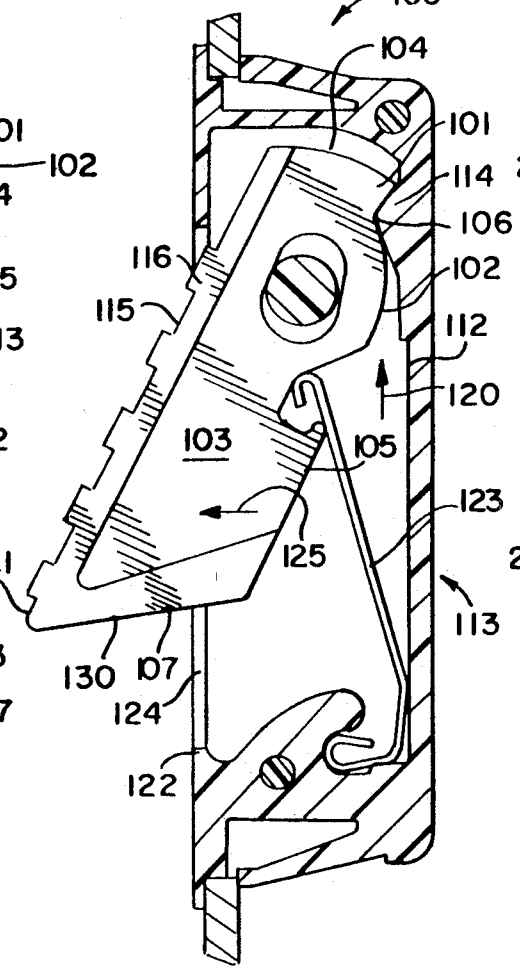
FIG. 6 is a longitudinal sectional view taken through a lock embodying the invention depicting the lock in its extended locked position.

Referring to FIGS. 5 and 6, when it is desired to engage the lower end 107 of the tumbler 103 with the header of the lower sash frame (not shown) to prevent upward sliding movement thereof, the tumbler 103 is actuated manually by lifting up on the forward edge 115, with the assistance of ribs 116. The tumbler 103 is moved upward as indicated by the arrow 120. Once the tumbler 103 has been moved upwards a sufficient distance to allow the engagement portion 121 of the tumbler 103 to clear the faceplate 122, the spring 123 propels the tumbler 103 forward through the vertical elongate opening 124 in the faceplate 122 in the direction of arrow 125. As the tumbler 103 pivots forward, the arcuate upper portion 102 of the tumbler 103 rotates until the apex 101 contacts the wedge-shaped protrusion 114 on the back wall 112. When the apex 101 contacts the protrusion 114, the vertical force created by the rotating tumbler 103 is directed downward into the protrusion 114. The protrusion 114 absorbs the rotating force, and stops the forward propulsion of the tumbler 103. The protrusion 114 also prevents any further rotation of the tumbler 103 if additional forces are applied to the extended portion 130. An increase in force against the extended portion 130 will cause the apex 101 to increase the vertical force on the protrusion 114, rather than direct a horizontal force against the back wall 112 of the casing 113, as occurred in the prior art lock 20. The protrusion 114 is capable of absorbing the increase in force without deforming the back wall 112 of the casing 113, thereby preventing the apex 101 of the tumbler 103 from rotating any farther than the protrusion 114.

The tumbler 103 is easily retracted within the opening 124 when it is desired to unlock the lower sash. By manually pushing the tumbler 103 inwardly, with the assistance of ribs 116, the apex 101 can be disconnected from the protrusion 114. After disconnection, with continued inward pushing, the upper arcuate portion 102 of the tumbler 103 rotates past the protrusion 114 until the tumbler 103 is in a vertical position. From the vertical position, the tumbler 103 can be locked in a retracted position by moving the tumbler downward until the engagement portion 121 contacts the faceplate 122, according to the above described procedure for the prior art lock.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A security lock for use in a sash window assembly having upper and lower sash window frames installed for vertical sliding movement, said upper sash frame having a recess into the interior thereof, said security lock comprising:

a casing adapted to be disposed in said recess, said casing including a cavity with a back wall therein;

a tumbler disposed in said cavity, said tumbler including a protruding apex at the top thereof;

pivot means for pivotally securing said tumbler to said casing for movement between an extended position where the bottom of said tumbler overlies the top of the lower sash to prevent upward movement of the lower sash above the bottom of said tumbler, and a retracted position within said cavity where the lower sash can be raised and moved past the tumbler;

spring means for biasing said tumbler into said extended position; and a protrusion extending said back wall, said protrusion adapted for engagement with the bottom of said apex during movement into said tumbler extended position, wherein when said protrusion engages said apex, said tumbler in said extended position creates a vertical component force directed downwardly from said apex into said protrusion, such that said tumbler resists further rotation and resists deformation of said back wall.

2. The security lock as defined in claim 1 wherein said tumbler includes forward and rear edges and a slot disposed midway between said edges, and said pivot means for pivotally securing said tumbler includes a lug inserted through said tumbler slot.

3. The security lock as defined in claim 2 wherein said slot is ovate.

4. The security lock as defined in claim 1 wherein said spring means is a leaf spring.

5. The security lock as defined in claim 4 wherein said leaf spring has one end engagable with a pocket disposed in said tumbler, normally to bias a lower end of said tumbler to protrude beyond said cavity into said extended position.

6. The security lock as defined in claim 1 wherein said protrusion is wedge-shaped.

7. A security lock for use in a double-hung sash window assembly having upper and lower sash window frames installed for vertical reciprocal sliding movement, one relative to the other, said upper sash frame having a recess into the interior thereof, said security lock comprising:

a casing adapted to be disposed in said recess having an opening to a substantially rectangular cavity disposed therein, said cavity including an upper, a lower and a back wall;

an elongated tumbler disposed in said cavity, said tumbler including a substantially arcuate upper portion with an apex protruding from said upper portion, forward and rear edges with an ovate slot disposed midway between said edges, a pocket disposed in said rear edge adjacent to said arcuate portion, an inclined lower edge, and a wedge-shaped indentation disposed below said apex in said arcuate portion;

a sidewall overlaying said cavity, said sidewall including a pivot lug secured thereto, said pivot lug adapted to be inserted in said tumbler ovate slot for movement of the tumbler relative to the sidewall between a retracted position and a locking position;

a leaf spring mounted between said lower wall of said cavity and said pocket, said leaf spring normally biasing said tumbler to protrude beyond said opening into said locking position; and, a wedge-shaped protrusion extending from the upper portion of said cavity back wall, said protrusion engaging said tumbler wedge-shaped indentation in an interlocking manner during movement into said locking position, such that said tumbler wedge-shaped indentation creates a vertical component force directed downwardly into said protrusion, so that said tumbler resists further rotation, resists deformation of said cavity back wall, and prevents relative sliding movement between said sash frames.

* * * * *

UNITED STATES PATENT AND TRADEMARK OFFICE

CERTIFICATE OF CORRECTION

PATENT NO. : 5,248,174

DATED : September 28, 1993

INVENTOR(S) : Dennis A. Matz/Steven E. Schultz

It is certified that error appears in the above-identified patent and that said Letters Patent is hereby corrected as shown below:

Column 1, before the BACKGROUND OF THE INVENTION, insert:

Technical Field

This invention relates generally to a manually operative lock for a window sash of a double-hung window assembly which permits limited opening of the window sash, and more particularly, to a novel construction which resists a greater opening force.

Related Patent

This application expressly incorporates the specification of U.S. Patent No. 4,923,230 by reference.

Column 3, line 9, after "sash" delete "21" and insert --12--.

Column 4, line 49, after "formation" delete "80" and insert --81--.

Signed and Sealed this

Thirteenth Day of June, 1995

Bruce Lehman

*Attest:*

BRUCE LEHMAN

*Attesting Officer*

*Commissioner of Patents and Trademarks*